United States Patent [19]

Rowe

[11] 4,301,829

[45] Nov. 24, 1981

[54] FLOOD CONTROL FOR A DISHWASHER

[75] Inventor: Richard A. Rowe, Louisville, Ky.

[73] Assignee: General Electric Company, Louisville, Ky.

[21] Appl. No.: 145,525

[22] Filed: May 1, 1980

Related U.S. Application Data

[63] Continuation of Ser. No. 970,826, Dec. 18, 1978, abandoned.

[51] Int. Cl.[3] ..... F16K 21/18; F16K 33/00

[52] U.S. Cl. ..... 137/387; 134/56 D; 134/57 D; 137/428; 137/429; 137/448; 73/322.5

[58] Field of Search ..... 134/56 D, 56 R, 57 D; 137/387, 428, 429, 430, 409, 434, 448; 4/395, 396; 73/322.5, 309, 319

[56] References Cited

U.S. PATENT DOCUMENTS

| | | | |
|---|---|---|---|
| 1,875,145 | 8/1932 | Ralston | 137/428 |
| 2,336,120 | 12/1943 | Null | 137/448 |
| 2,399,099 | 4/1946 | Caron | 137/429 |
| 2,559,046 | 7/1951 | Peters et al. | 137/448 |
| 3,342,207 | 9/1967 | Ross | 137/448 |
| 3,464,437 | 9/1969 | Zane | 137/429 |
| 3,835,880 | 9/1974 | Hoffman et al. | 137/387 |
| 3,894,555 | 7/1975 | Payne | 73/322.5 |
| 3,982,557 | 9/1976 | Acevedo | 137/448 |
| 4,013,091 | 3/1977 | Hudson | 137/433 |
| 4,119,116 | 10/1978 | Johnson et al. | 137/387 |
| 4,180,095 | 12/1979 | Woolley et al. | 137/429 |

FOREIGN PATENT DOCUMENTS

| | | | |
|---|---|---|---|
| 606167 | 7/1960 | Italy . | |
| 562 | of 1878 | United Kingdom | 137/448 |

*Primary Examiner*—Martin P. Schwadron
*Assistant Examiner*—G. L. Walton
*Attorney, Agent, or Firm*—H. Neil Houser; Radford M. Reams

[57] ABSTRACT

A flood control arrangement for dishwashers in which the in-flow to the dishwasher tub from the water supply line is automatically terminated in the event the tub water rises to a flood level. The arrangement includes a sealing plunger disposed in a plunger body member housing installed downstream of the water fill valve. The sealing plunger tends to be moved to the sealing position by the line water pressure to shut off in-flow to the dishwasher but is blocked from movement to this position whenever the water level is below the flood level by the stem of a float positioned in the dishwasher tub. When the water level in the tub approaches the flood level, the float rises in the tub to a position whereat the float stem releases the sealing plunger to allow it to move to the sealing position and shut off further flow to the dishwasher. The float stem either causes the sealing plunger to be tilted off a sealing face or prevents it from moving laterally in the line to the sealing position in order to produce the blocking action.

9 Claims, 4 Drawing Figures

FLOOD CONTROL FOR A DISHWASHER

CROSS-REFERENCE TO RELATED APPLICATION

This application is a continuation of application Ser. No. 970,826, filed Dec. 18, 1978, now abandoned, the disclosure of which is hereby incorporated by reference.

BACKGROUND DISCUSSION

Modern automatic dishwashers generally include an automatic control of in-flow of water from the water supply into the machine. This automatic control is typically provided by a timer which causes a fill valve to be opened at the appropriate point in the machine cycle for a predetermined time interval, allowing water flow into the dishwasher tub over this interval. Such automatic control creates the possibility of a flooding condition being reached in which water overflows the level of the tub and out of the machine where it may cause damage. Such a flooding condition may occur for a variety of reasons, such as failure of the fill valve, over pressure line conditions, clogged dishwasher drain, etc. Many dishwasher designs accordingly provide for some arrangement for flood control.

In some of these designs, a fail-safe mechanism is incorporated into the electrical control which will correct flood level conditions occurring during the machine cycle. Some failure modes, however, such as a mechanical failure of the valve may occur at any time, not only during the machine operation. Thus, 24-hour flood control protection is a desirable feature in such machines.

In U.S. Pat. No. 3,894,555, a flood control feature is disclosed in which a float is mounted within the dishwasher tub which acts to de-energize a secondary electrically operated valve installed downstream from the fill valve. If a flood level occurs in the tub, the float rises to the flood level and acts to operate an associated switch to open the circuit to the secondary flood control valve, causing closing of the valve and cessation of flow to the tub.

The secondary valve adds significantly to the expense of manufacture, since an additional, relatively costly, electrically operated valve is required. In addition, the reliability of electrically operated valves is less than mechanically operated valves and any failure of the valve will cause either malfunction of the dishwasher or defeat of the flood control feature.

Accordingly, it is an object of the present invention to provide a flood control arrangement for washing machines in which 24-hour flood control protection is afforded.

It is a further object of the present invention to provide such a flood control feature which operates in a highly reliable manner, but does not substantially add to the cost of manufacture of the machine.

SUMMARY OF THE INVENTION

These and other objects of the present invention, which will become apparent upon a reading of the following specification and claims, are accomplished by the provision of a flood control valve comprised of a movable sealing plunger disposed in a plunger housing having internal openings establishing fluid communication through the valve.

The sealing plunger is provided with a sealing head having a sealing surface and is adapted to be urged into a sealing engagement with a valve seat surface in the plunger housing by water line pressure to prevent flow into the dishwasher. The sealing engagement of the sealing plunger is blocked except when flood conditions exist in the dishwasher tub by means of a float disposed in the dishwasher tub having a stem portion engaging a stem portion of the plunger seal such as to preclude sealing engagement of the head portion.

In one version, this is accomplished by the float stem being set into an aligned position with the end of the plunger seal stem preventing it from being moved against the valve seat.

In the second version, the float stem engages the side of the sealing plunger stem causing it to be tilted and misaligned with the valve seat. If a flood condition occurs, the float rises sufficiently to release the float stem from blocking engagement with the sealing plunger allowing line water pressure to move the plunger seal into sealing engagement and discontinue further in-flow to the dishwasher.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
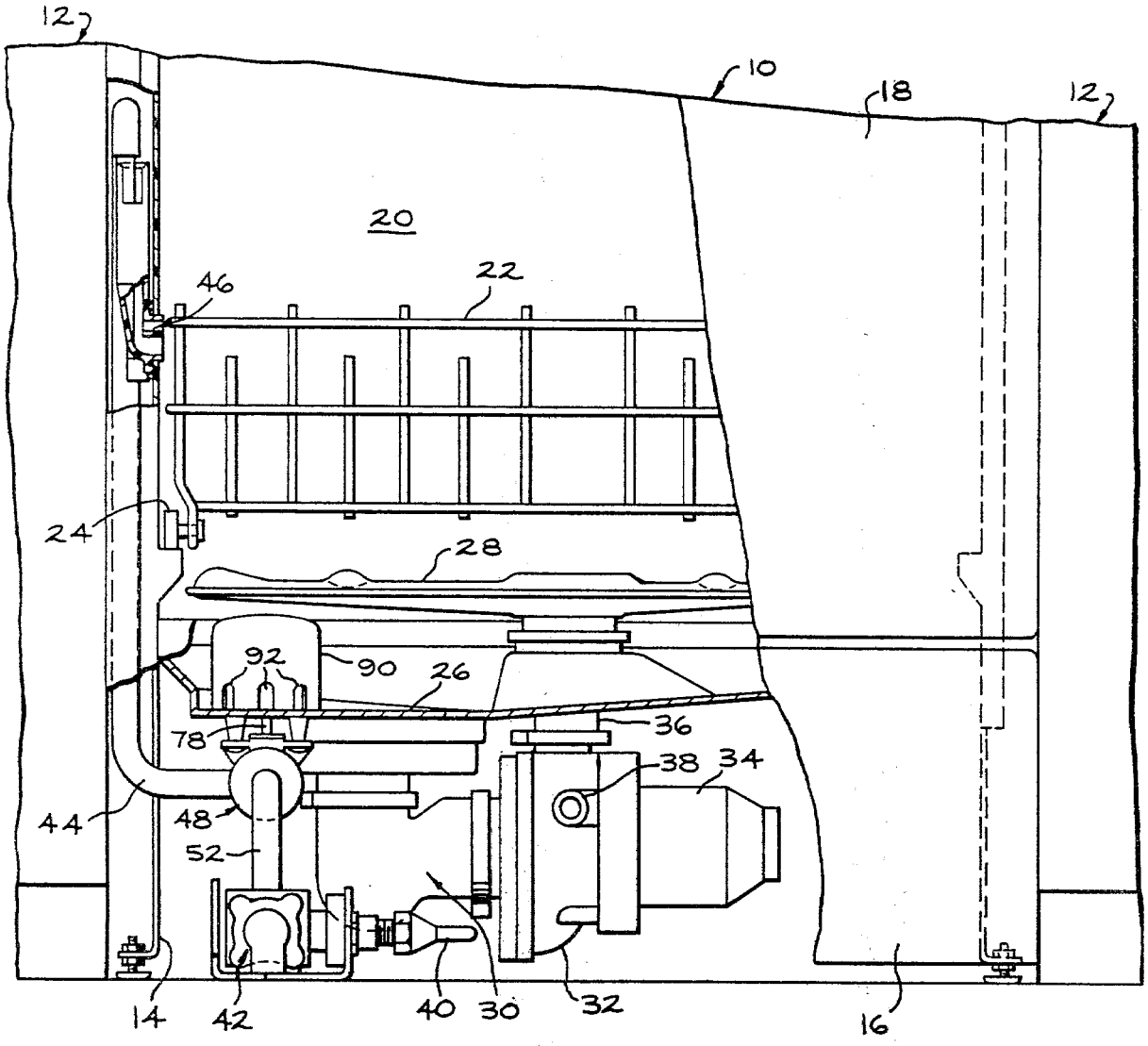
FIG. 1 is a fragmentary view of a dishwasher in front elevation shown in partial section to depict the relationship of the components of the present invention to the dishwasher structure.

Referring to the drawings and particularly FIG. 1, a conventional dishwasher 10 is depicted into which is incorporated the flood control arrangement according to the present invention. The dishwasher illustrated is of the built-in cabinet style, installed between adjacent kitchen cabinetry 12. The dishwasher 10 includes an inner frame 14 to which is mounted the outer cabinet panel 16 which provides access to the operating components, and front mounted access door 18 provides access to the interior 20 of the dishwasher.

In the dishwasher interior 20 are mounted one or more racks 22 adapted to receive the dishware items to be washed. Such racks 22 are mounted on rollers 24 for in and out movement for convenient loading of the dishware items.

The lower region of the interior 20 is comprised of a tub 26 which acts to collect the water introduced into the machine and directed in a high pressure spray at the dishware items. The washing action is carried out by means of a rotary spray arm 28 into which is circulated water under high pressure in order to wash and rinse the dishware items disposed in racks 22.

The water collected in tub 26 is directed through an inlet fitting 30 to the inlet side of a pump 32, driven by an electric motor 34.

The outlet 36 of pump 32 communicates with internal flow passages to provide the high pressure circulation to the rotary spray arm 28 during the wash and rinse cycles.

After the wash and rinse cycles, the water in the tub 26 is pumped via drain outlet 38 to a plumbing drain.

In order to provide the proper volume of water necessary for the wash and rinse cycles, an automatic fill arrangement is provided for introducing the water from the hot water connection into the machine. This arrangement conventionally includes a hot water pipe shown partially at 40 in communication with the hot water supply. The hot water pipe 40 is in fluid communication with a fill valve assembly 42 which is solenoid operated to establish a timed interval of communication at the appropriate points in the machine cycle with a fill hose 44, which extends upwardly along the dishwasher cabinetry and is placed in communication with a fill nozzle fitting 46 which directs the hot water into the interior of the machine during the fill cycle.

The flood control arrangement, according to the present invention, acts to mechanically prevent water flow from the fill valve assembly 42 into the tub 26 whenever flood conditions within the tub 26 are approached.

Figure 2:
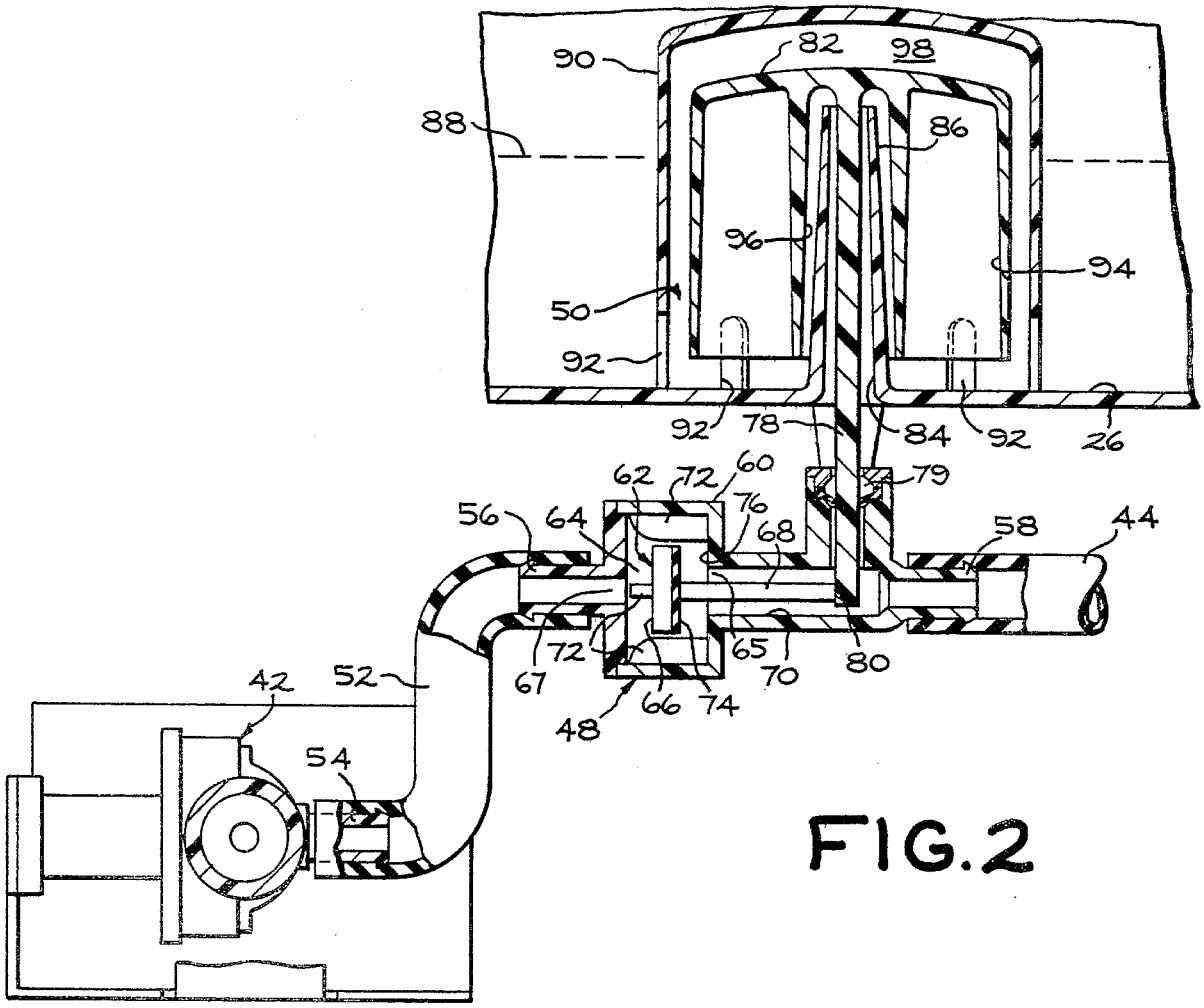
FIG. 2 is a view in partial section of the major components of the flood control arrangement according to the present invention as shown in FIG. 1.

The flood control arrangement as seen in FIG. 2 consists of the combination of a flood control valve 48 and a float assembly 50. The flood control valve 48 is in fluid communication with the fill hose 44 and the fill valve assembly 42. A short length of hose 52 joins the outlet fitting 54 of the fill valve assembly 42 and an inlet fitting 56 of the flood control valve 48. The outlet of the flood control valve 48 is secured to the fill hose 44 to thus be placed in fluid communication with the fill circuit downstream of the fill valve assembly 42.

The flood control valve 48 consists of a plunger housing 60 within which is movably mounted a sealing plunger 62. The plunger housing 60 is formed with a relatively large diameter inlet chamber 64. Inlet chamber 64 has an inlet port 67 in fluid communication with the outlet of fill valve assembly 42 and an outlet port 65 in fluid communication with tub 26 through fill hose 44. Inlet chamber 64 receives a sealing head portion 66 of the sealing plunger 62. A stem 68 of the sealing plunger 62 extends through the outlet port 65 into an elongated passage 70 in communication with the inlet chamber. Passage 70 is of a larger diameter than the stem 68 to allow water flow around the stem 68 through the passage 70. Sealing head 66 is positioned radially in the inlet chamber 64 by a plurality of circumferentially spaced webs 72 which allow flow around the sealing head 66 and into the passage 70 with the sealing plunger 62 held in position as shown in FIG. 2.

The effective inlet water pressure exerted by water received from the fill valve assembly 42 acts on the sealing head 66 and urges the sealing plunger 62 to the right as viewed in FIG. 2. A valve seating surface 74 is provided on the opposite face of the sealing head 66 from the direction of water pressure and is adapted to seatingly engage an annular valve seating surface 76 formed on the end wall of the inlet chamber 64, such that upon movement of sealing head 66 into engagement with surface 76, shutoff of the water flow downstream of the flood control valve 48 is provided.

The sealing plunger 62 is maintained in its unseated position shown in FIG. 2 by blocking means including a float stem member 78 having its end portion positioned in abutment with the end face 80 of the stem 68. The float stem member 78 moves with a float 82 positioned in the bottom of tub 26, with the float stem member 78 passing through the interior opening 84 of a float guide 86. Float guide 86 extends upwardly over the flood level indicated at line 88 such that water will not flow through the interior opening 84 through which the float stem member 78 enters.

A seal 79 is provided in the plunger housing 60 which prevents the water from passing out between the float stem member 78 and the plunger housing 60.

Surrounding the float 82 is a protective float housing 90 with inlet cutouts 92 provided to enable the water to pass into the interior of the float housing 90. Float 82 is provided with an annular bell chamber 94 with an inner opening 96 provided adjacent the float guide 86 to enable venting of the air and allowing the water level to thereby rise into the interior 98 of the float housing 90.

The float guide 86 also insures guiding movement of the float to prevent tipping movement.

The relative weight and buoyancy of the float 82 is such that it will not rise in the housing appreciably until the predetermined flood level indicated at line 88 is approached. When the liquid level in the tub reaches the predetermined flood level, the buoyancy force moves the float 82 vertically upwardly with the float stem member 78 moving out of blocking engagement with the end face 80 of the stem 68. The water pressure acting on the sealing head 66 forces the sealing head into sealing engagement with the valve seating surface 76 to shut off further water in-flow to the dishwasher.

The buoyant force is increased by the annular bell chamber 94 and also may be contributed to by buoyancy of the material itself by employing a molded plastic material of a specific gravity less than 1.

Accordingly, as the water level in the tub 26 approaches the flood level indicated at line 88, the float 82 rises vertically freeing the end of the stem 68 allowing sealing head 66 to be forced against the annular surface 76, discontinuing further in-flow to the fill hose 44 and the tub 26.

Accordingly, it can be seen that an entirely mechanically operated flood control arrangement is provided which does not require operation of the electrical controls of the dishwasher to provide 24-hour protection. The mode of operation using water pressure to create the valve sealing action provides a high degree of reliability in preventing flooding due to either electrical or mechanical malfunction of the fill valve assembly 42, or other conditions, such as a clogged drain.

Once an overfill condition has occurred, the refilling of the tub is precluded by movement of the stem 68 beneath the float stem member 78, such that the owner or operator of the machine is apprised of the fact that there has been a system malfunction creating the flood condition. The machine will therefore be caused to receive proper maintenance attention prior to another use of the dishwasher. The stem 68 is easily repositioned by removal of the hoses 52 and 44, after insuring that the fill valve has functioned to close and repositioning of the sealing plunger 62 has occurred (FIG. 2).

Figure 3:
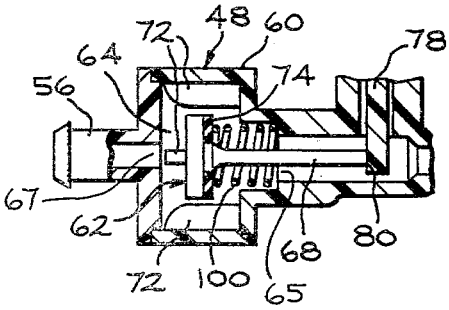
FIGS. 3 and 4 are sectional views of the sealing plunger and associated plunger housing, depicting the alternate versions of the present invention.

FIG. 3 depicts the alternate mounting arrangement for the sealing plunger 62 in which a spring 100 is employed to make the repositioning operation simpler, i.e., upon relief of pressure in the inlet chamber 64, the spring 100 will reposition the sealing plunger 62 in the appropriate unsealed position enabling the valve stem member 78 to be repositioned behind the end face 80.

Figure 4:
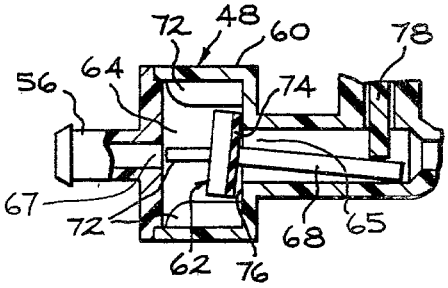

FIG. 4 depicts an alternate embodiment in which the valving action is controlled by a side engagement of the float stem member 78 with the stem 68. The valve stem member 78 causes the sealing plunger 62 to be tilted, thus precluding the sealing engagement of the valve seating surfae 74 with the annular surface 76 until such time as the float rises upon the creation of a near flood condition in the tub 26.

These embodiments offer the same advantages as the preferred embodiment described in FIG. 2. It can be seen that this design achieves the above-recited objects of the invention producing a relatively simplified but reliable and mechanical flood control arrangement which offers 24-hour protection against flooding and which may be incorporated at relatively low cost.

The embodiments of the invention in which an exclusive property or privilege is claimed are defined as follows:

1. A flood control arrangement for a washing machine of the type having a tub for collecting liquid and liquid in-flow means for providing a controlled in-flow of liquid to the tub from an external supply means, the in-flow means including an electrically operated solenoid valve and means directing liquid from the outlet of the electrically operated solenoid valve into the tub, said flood control arrangement comprising:

flood control valve means interposed in the liquid in-flow means downstream from the electrically operated solenoid valve, said flood control valve means including a plunger housing and a sealing plunger disposed in said plunger housing, said plunger housing being formed with an inlet chamber having an inlet port in fluid communication with the outlet of said electrically operated solenoid valve, and an outlet port in fluid communication with the interior of the tub, said plunger housing further including a valve seat formed between said inlet port and said outlet port, said sealing plunger having a head portion disposed in said inlet chamber between said inlet port and said outlet port and movable therein to a sealing position in sealing engagement with said valve seat by pressure exerted on said head portion by liquid received in said inlet chamber, said sealing plunger being operative in its sealing position to prevent liquid flow into the tub;

a float disposed in the bottom region of the tub adapted to be raised to a predetermined flood position upon rising of the liquid level in the tub to a predetermined flood level approaching a flood condition in the tub;

blocking means including a block member drivingly connected to said float and normally engaging said sealing plunger to prevent movement of said sealing plunger to its sealing position when said float is below its predetermined flood position, said blocking member being operative to disengage said sealing plunger when said float moves to its flood position thereby enabling movement of said sealing plunger to its sealing position.

2. The flood control arrangement according to claim 1 wherein said blocking member comprises a float stem member secured to said float and extending downwardly through the tub bottom into the interior of said plunger housing, said float stem member having a portion thereof operative to engage said sealing plunger to prevent movement of said sealing plunger to its sealing position when the liquid level in the tub is less than the flood level and operative to move out of engagement therewith upon movement of said float to its predetermined flood position.

3. The flood control arrangement according to claim 2 further including a float housing substantially enclosing said float, said float housing being formed with openings allowing liquid in the tub to enter said float housing.

4. The flood control arrangement according to claim 1 wherein said blocking member includes a stem portion extending into said plunger housing into the path of movement of said sealing plunger, said float stem member being movable out of the path thereof upon movement of said float to its predetermined flood position, thereby permitting said sealing plunger to be moved to its sealing position by the pressure exerted by liquid received in said inlet chamber.

5. The flood control arrangement according to claim 4 wherein said plunger housing includes a bore in communication with said inlet chamber through said outlet port and said sealing plunger has a stem portion extending into said bore and wherein said stem portion of said blocking member normally extends laterally into said bore blocking movement of said sealing plunger stem portion to its seated position, said float being operative to move said stem portion of said blocking member clear of said sealing plunger stem portion upon movement of said float to its predetermined flood position, whereby the movement of said sealing plunger to its sealing position is enabled only when said float is in its predetermined flood position.

6. The flood control arrangement according to claim 5 further including spring means interposed between said sealing plunger head portion and the interior of said inlet chamber urging said sealing plunger out of sealing engagement with said valve seat, whereby said sealing plunger may be repositioned out of its sealing position upon cessation of the pressure exerted on said sealing plunger head portion.

7. The flood control arrangement of claim 5 wherein said sealing plunger stem portion is operative upon movement of said sealing plunger to its sealing position to prevent said blocking member stem portion from extending into said bore whereby said sealing plunger remains in its sealing position until manually repositioned.

8. The flood control arrangement according to claim 1 wherein said sealing plunger includes a stem portion affixed to said head portion and wherein said plunger housing includes a bore extending out of said inlet chamber through said outlet port, and wherein said stem portion extends into said bore with a clearance thereof, and wherein said blocking member extends into said bore and into engagement with a side surface of said sealing plunger stem portion engaging said stem portion to cause tilting of said sealing plunger head portion to preclude sealing engagement of said head portion with said valve seat, and wherein upon movement of said float to its predetermined flood position, said blocking member is moved out of engagement with said stem portion enabling movement of said sealing plunger to its sealing position.

9. The flood control arrangement according to claim 1 wherein said plunger housing further includes a plurality of radially inwardly projecting webs circumferentially spaced about said inlet chambers extending into sliding engagement with said sealing plunger head portion, to position said head portion in said chamber enabling liquid flow around said head portion through the spaces in between said circumferentially spaced webs.

* * * * *